US005401153A

United States Patent [19]

Katagiri et al.

[11] Patent Number: 5,401,153

[45] Date of Patent: Mar. 28, 1995

[54] PRESS FOR POWDER METALLURGY

[75] Inventors: Takeshi Katagiri, Machida; Shiro Shirasaki, Yokohama; Masao Yamamoto, Kawasaki, all of Japan

[73] Assignee: Yoshizuka Seiki Co., Ltd., Kawasaki, Japan

[21] Appl. No.: 155,866

[22] Filed: Nov. 23, 1993

[51] Int. Cl.[6] ..... B30B 11/02

[52] U.S. Cl. ..... 425/78; 425/193

[58] Field of Search ..... 425/78, 183, 185, 193, 425/411

[56] References Cited

U.S. PATENT DOCUMENTS

| | | | |
|---|---|---|---|
| 4,134,716 | 1/1979 | John, Jr. | 425/193 |
| 4,347,051 | 8/1992 | DeSantis | 425/193 |
| 4,379,684 | 4/1983 | Katagiri et al. | 425/78 |
| 4,773,839 | 9/1988 | Case et al. | 425/193 |

FOREIGN PATENT DOCUMENTS

| | | |
|---|---|---|
| 62-33039 | 7/1987 | Japan . |
| 62-55960 | 11/1987 | Japan . |
| 2-37280 | 8/1990 | Japan . |

*Primary Examiner*—James P. Mackey
*Attorney, Agent, or Firm*—Kanesaka & Takeuchi

[57] ABSTRACT

The invention provides a press for powder metallurgy in which a die set installed between an upper ram and a lower ram of a main body of the press can be easily fixed or removed and the accuracy of the molded product is improved. An upper part of the lower ram to which a yoke plate of the die set is installed or is provided with a gap adjusting screw displaceable with thread engagement in vertical direction. A hydraulic actuator or other rotary driving device is fixed to a lower part of the lower ram. A driving shaft of the rotary driving device is connected to the gap adjusting screw by a connecting shaft which passes through an axial center of the lower ram. When the die set is installed in the main body of the press, the gap adjusting screw is retracted within the lower ram so as to assure a sufficient gap between the yoke plate and the lower ram. When insertion of the die set is completed, the gap adjusting screw is advanced forwardly to abut against the yoke plate and thus they can be assembled with a gap having no clearance approximating to zero.

3 Claims, 4 Drawing Sheets

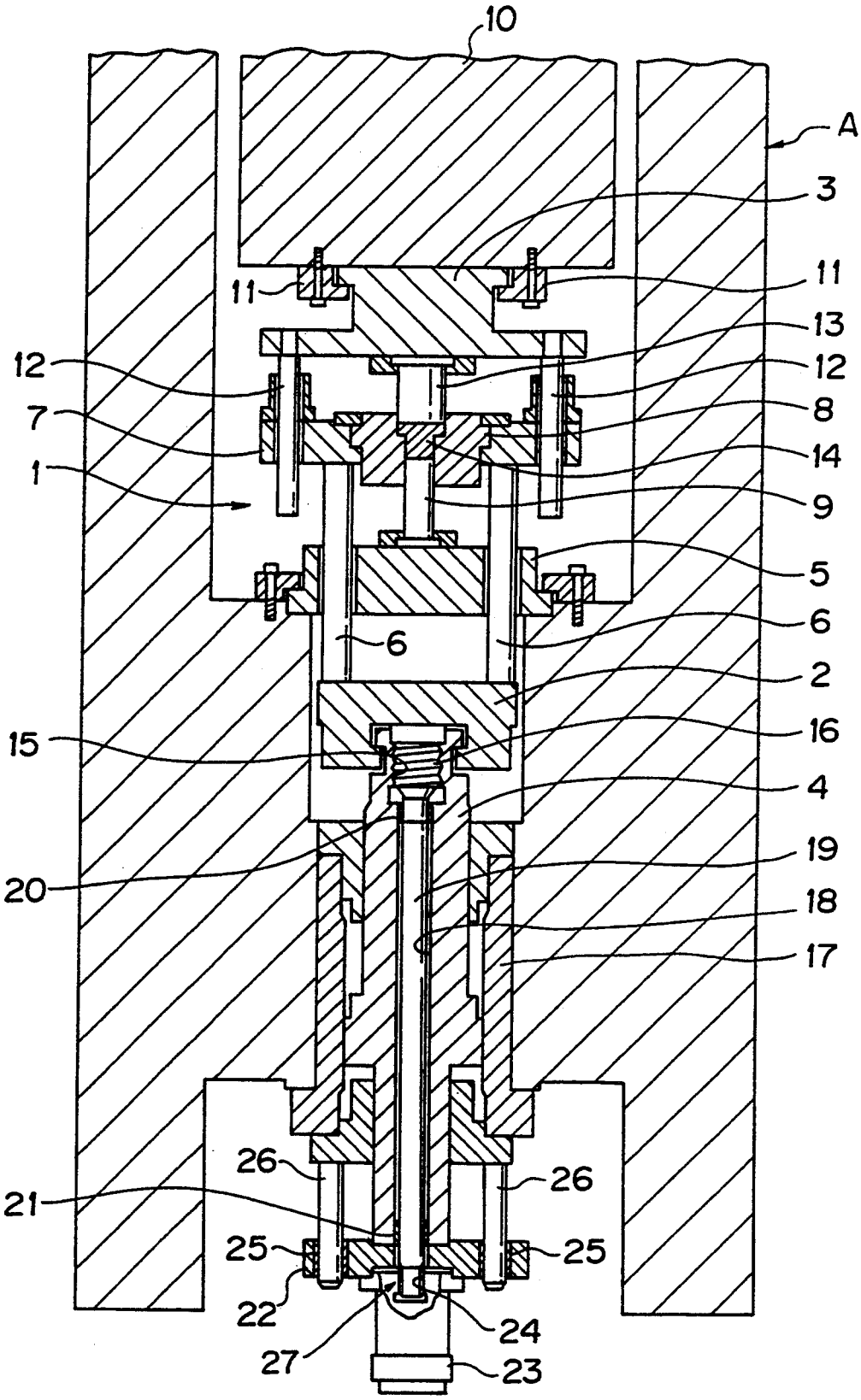
10
A
3
11
11
13
12
12
7
8
1
14
9
5
6
6
2
15
16
4
19
20
18
17
26
26
21
25
25
22
24
27
23

PRESS FOR POWDER METALLURGY

BACKGROUND OF THE INVENTION

1. Field of the Invention

The present invention relates to a press for powder metallurgy in which a gap between a lower ram and a yoke plate is adequately adjusted to facilitate replacement of a die set and to improve accuracy of a formed product.

2. Description of Invention

In the press for powder metallurgy, it is necessary to replace a die set due to change of a product to be formed. As this type of prior art die set replacing device, there has been known "Die Set Replacement Device for Press for Powder Metallurgy" of Jap.Pat.-Publn.No.Sho. 62-33039, "Loader Device for Forming Press" of Jap.Pat.Publn.No.Sho. 62-55960, "Die Set Replacement Device for Press for Powder Metallurgy" of Jap.Pat.Publn.No. Hei 2-37280 and the like. These replacement devices are used for installing or removing a large-sized die set to or out of the main body of the press for powder metallurgy. A small-sized die set is manually replaced.

One example of configuration of the aforesaid prior art die set will be described in reference to FIG. 3. A die set 1 is comprised of component elements illustrated in the FIG. 3 from a yoke plate 2 to an upper punch plate 3. The yoke plate 2 is removably engaged with a lower ram 4 which is installed at a lower part of a main body A of the press for powder metallurgy as it can displace or move vertically. Guide rods 6 are projected upwardly on the yoke plate 2 which is engaged with the lower ram 4. The guide rods 6 pass through a stationary plate 5, and a die plate 7 is secured to the upper ends of the guide rods 6. The stationary plate 5 is secured to the main body A of the press by bolt fastening or a hydraulic clamp through a holder at a predetermined height position. The stationary plate 5 carrys a lower punch 9 which is inserted or fitted into a die 8 disposed at the central part of the die plate 7.

The upper punch plate 3 is removably secured against clamper 11 provided at an upper part of the main body A of the press for powder metallurgy. The clamper 11 is provided to a lower surface of an upper ram 10 which is displaced or moved upward or downward by a driving means not shown. Guide rods 12 passing through the die plate 7 are provided to a lower surface of the upper punch plate 3 so that of the upper punch plate 3 is vertically guided by the guide rods 12. An upper punch 13 inserted or fitted into the die 8 is provided to the lower surface of the upper punch plate 3.

Powder material which is filled in a pressing cavity defined by the die 8 and the lower punch 9 inserted into the die from the bottom side thereof is pressed between the upper and lower punches 9 and 13 so as to form a powder molded product 14.

For installing or removing of the die set 1 to or from the main body A of the press, it is required to align height positions between the upper punch plate 3 and the lower ram 4 for smooth horizontal sliding of the yoke plate 2 in relation to the lower ram 4 with using a replacement device already known as the prior art. It is necessary to provide in general a gap G of about 0.1 to 0.3 mm between the yoke plate 2 and the lower ram for the above operations.

The die set 1 is carried by the main body A of the press via three locations of the upper punch plate 3, the stationary plate 5 and the yoke plate 2. It is known that accuracy of molded product is affected significantly with condition of securing between the yoke plate 2 and the lower ram 4. In order to assure the accuracy of the product, it is desired to fix the yoke plate 2 and the lower ram 4 with no clearence between them so that the gap G is a minimum approximating zero.

Thus, in order to improve the accuracy of a formed product, it is required to arrange the interval of the gap G to a minimum one approximating zero during pressing operation. On the contrary, in order to facilitate replacement of the die set 1, it is desired to arrange the interval of the gap G as large as possible.

A hydraulic clamper or a bolt clamper having a low force might be used as the clamper 11 because no other force than self weight of the upper punch 3 is applied to the clamper 11 during the ascending of the upper ram 10. The clamper part of the stationary plate 5 might be also fixed by the same manner because a force acting in the direction for ascending thereof is not so large too.

During a pressing operation, the lower ram 4 abutting to the lower surface of the yoke plate 2 receives a large load. Meanwhile during an operation that a pressed and molded product is retracted, the yoke plate 2 is concurrently pulled down by the lower ram 4. Due to these facts, clearance between the yoke plate 2 and the lower ram 4 is desirable to be a value as less as possible.

Moreover, in view of that the gap G between the yoke plate 2 and the lower ram 4 provides substantial influence over the accuracy of the molded products 14, said gap G is desirable to be minimum one approximating zero as much as possible. In FIG. 3, a force applied from the upper punch 13 to the lower ram 4 during a pressing operation is indicated with an arrow P1. A force received by the lower ram 4 when the molded product 14 is pulled out of the device is indicated by an arrow P2 in FIG. 4. In a case a large size product is made, the force applied during pulling-out operation sometimes reaches 60% of that applied during pressing operation.

At starting time of molding operation, there is no friction between the die 8 and the lower punch 9 for no powder material lies between them. However if the powder material enters between them accidentally during operation, friction occurs and sometimes becomes a considerably large value. The friction also occurs due to poor accuracy between the guide rods 6 and insertion holes **5*a* receiving the rods 6**.

When the lower ram 4 being lifted up is stopped at a predetermined height in order to fill the powder material into the pressing cavity, an assembly including the yoke plate 2, the guide rods 6 and the die plate 7 is also stopped in a state that it projects upward due to its inertia by a length corresponding to the gap G. Then if the friction is not so large, the assembly descends by its own weight until the lower part of the yoke plate 2 abuts against the upper part of the lower ram 4. Then filling position of the powder material to said pressing cavity might be a certain height. However, if the friction is so large that descending of the assembly which is projected upward by the gap G is prevented with the friction, the filling position of the powder material to said pressing cavity shifts to a position higher than the above certain height by the gap G. Moreover if the friction is exceedingly large, the yoke plate 2 and the lower ram 4 are secured each other with the friction so that no projection of the assembly by the gap G during lifting operation occurs.

Due to the fact that the filling position of the powder material into the pressing cavity is so varied as described above, there may occur disturbances in the filling amount of the powder material so as to cause the accuracy of the pressed and molded product to be remarkably spoiled. For example, if there occurs the disturbance of 0.3 mm in the product having the filling depth of 20 mm, the error in the molded product 14 becomes $0.3/20\times100=1.5\%$, resulting in showing an amount which can not be ignored.

Therefore it is an object of the present invention to provide a press of powder metallurgy for solving the problems in the prior art as described above, wherein a large gap is provided between the die set and the lower ram when the die set is to be installed in or removed from the main body of the press, for facilitating displacement of the die set in relation to the main body of the press, while pressing operation is performed with the minimum gap one approximating zero for improving the accuracy of the molded product.

SUMMARY OF THE INVENTION

In order to accomplish the above object, a press of powder metallurgy of the present invention is composed of a vertically displaceable gap adjusting screw provided at the upper part of the lower ram over which the yoke plate of the die set is engaged or disengaged as the die set is installed to or removed from the main body of the press, a rotational driving means, e.g. a hydraulic actuator, etc., provided at the lower part of the lower ram, and a connecting shaft passing through a central part of the lower ram, which connects a driving shaft of the rotational driving means to the gap adjusting screw.

According to the aforesaid configurations, if the gap adjusting screw is rotated by the rotational driving means to cause the screw to be retracted into the lower ram, the gap between the yoke plate and the lower ram can be sufficiently assured and the die set can be easily inserted into or removed from the main body of the press.

Once the die set is installed into the main body of the press, the gap between the yoke plate and the main body might be set to minimum one approximating zero by upward advancing of the gap adjusting screw until it abuts to the lower surface of the yoke plate by driving of the rotational driving means.

BRIEF DESCRIPTION OF THE DRAWING

FIG. 1 is a longitudinal sectional view for showing one preferred embodiment of the press of powder metallurgy according to the present invention.

DESCRIPTION OF THE PREFERRED EMBODIMENT

Figure 2A:
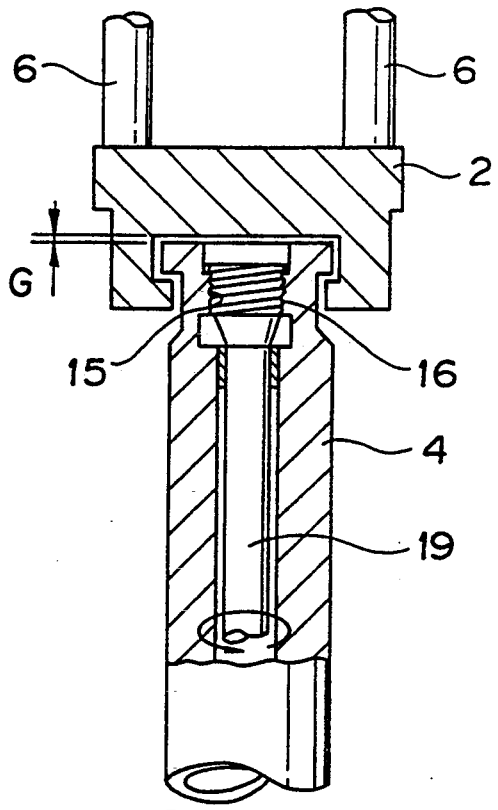
FIG. 2A is a longitudinal sectional view for showing the state in which the gap adjusting screw is fully retracted and FIG. 2B is a longitudinal sectional view for showing another state in which the gap adjusting screw is fully advanced, respectively.

Referring now to the drawings, one practical preferred embodiment of the press for powder metallurgy of the present invention will be described in detail as follows. Same reference numerals are applied to the same portions as those of the prior art so as to eliminate the descriptions of overlapped portions.

In FIG. 1 is illustrated a longitudinal sectional view for showing a press for powder metallurgy of this type. A female thread 15 is formed at the upper part of a lower ram 4 in vertical direction at the central part thereof. A yoke plate 2 of a die set 1 is removably secured to the upper part of said lower ram 4. A gap adjusting screw 16 is engaged with said female thread 15. An insertion hole 18 is formed in said lower ram 4 as it passes through the central part thereof. Said lower ram 4 is displaced vertically with driving of a hydraulic cylinder 17. A connecting shaft 19 which is fitted into said insertion hole 18 is rotatable and vertically-displaceable due to arrangement of metallic bearings 20 and 21 disposed at upper and lower locations of said insertion hole 18. The upper end of said shaft 19 is secured to the lower part of said gap adjusting screw 16.

An actuator supporting plate 22 is secured at the lower end of said lower ram 4 and a hydraulic operated rotary actuator 23 is attached to the lower surface of said actuator supporting plate 22 in an upward direction. The lower end of said connecting shaft 19 passing through said supporting plate 22 to face is connected to a driving shaft 24 of said rotary actuator 23 through a linking means or spline 27. Guide means or rods 26 projecting from the lower cover of a hydraulic cylinder 17 pass through bushings 25 secured in said supporting plate 22 so that said rods 26 prevent rotary displacement of said supporting plate 22 around said shaft 19 while they guide vertical displacement of said supporting plate 22.

The gap G between said yoke plate 2 and said lower ram 4 is easily adjusted with operation of said rotary actuator 23 under hydraulic pressure for rotating said driving shaft 24 which causes advance or retraction of said gap adjusting screw 16 via said connecting shaft 19. The terminal end of rotary operation of said actuator 23 is set to a position where more advance of said gap adjusting screw 16 is prevented with abutting thereof to the lower surface of said yoke plate 2.

In order to insert the die set 1 into the main body A of the press, said gap adjusting screw 16 is rotated in a counter-clockwise direction by operation of said rotary actuator 23 until said adjusting screw 16 is fully retracted within said female thread part 15 as shown in FIG. 2A. With such an arrangement, a sufficient interval greater than that of the prior art can be provided as the gap G between said yoke plate 2 and said lower ram 4 so that the insertion of the die set 1 into the main body A of the press can be performed quite easily.

Figure 2B:
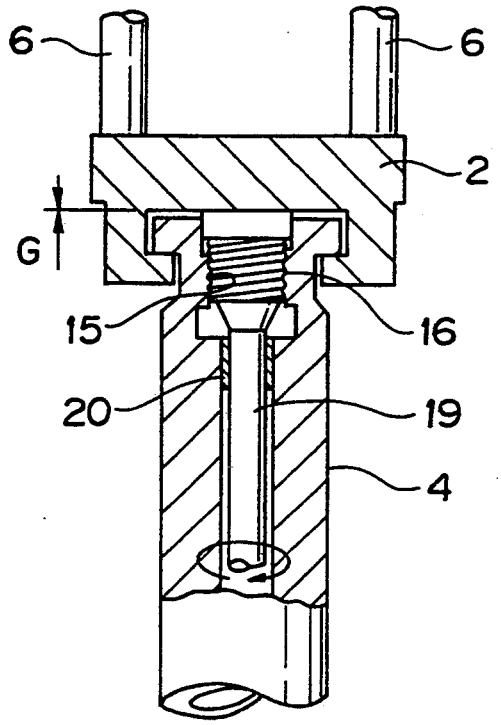
Figure 3:
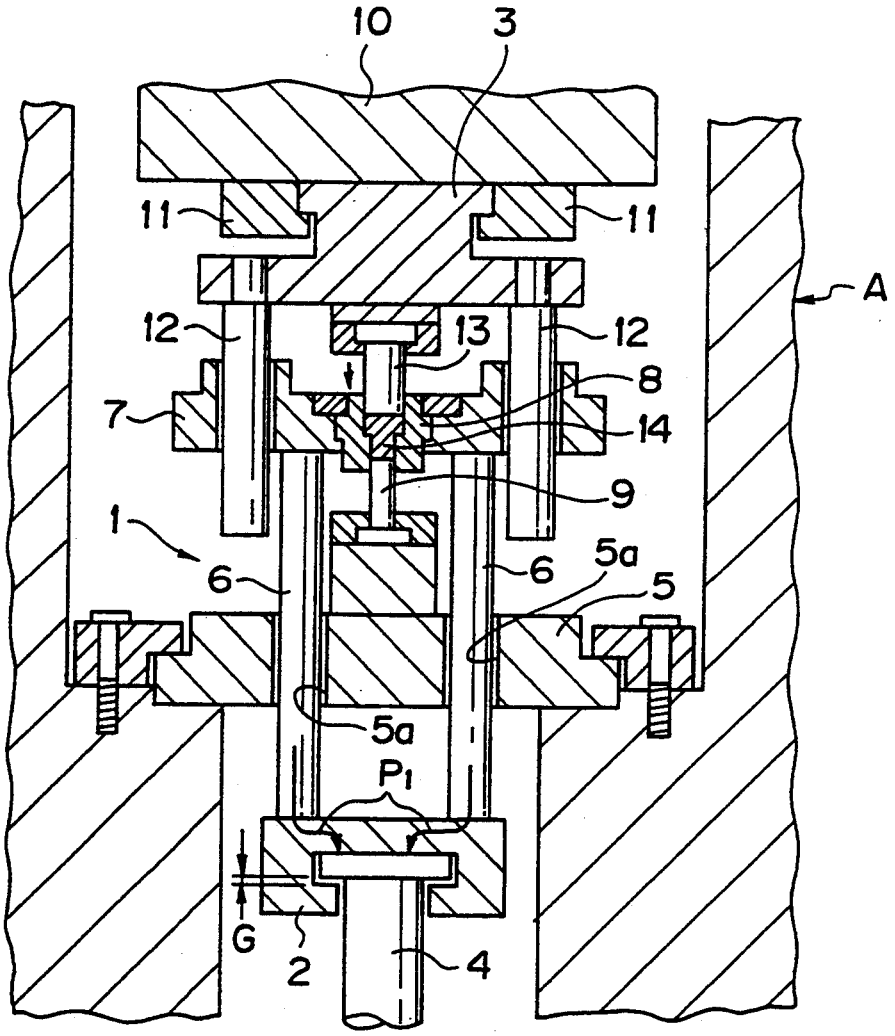
FIG. 3 PRIOR ART
FIG. 3 is a longitudinal sectional view for showing the press of powder metallurgy of the prior art.
Figure 4:
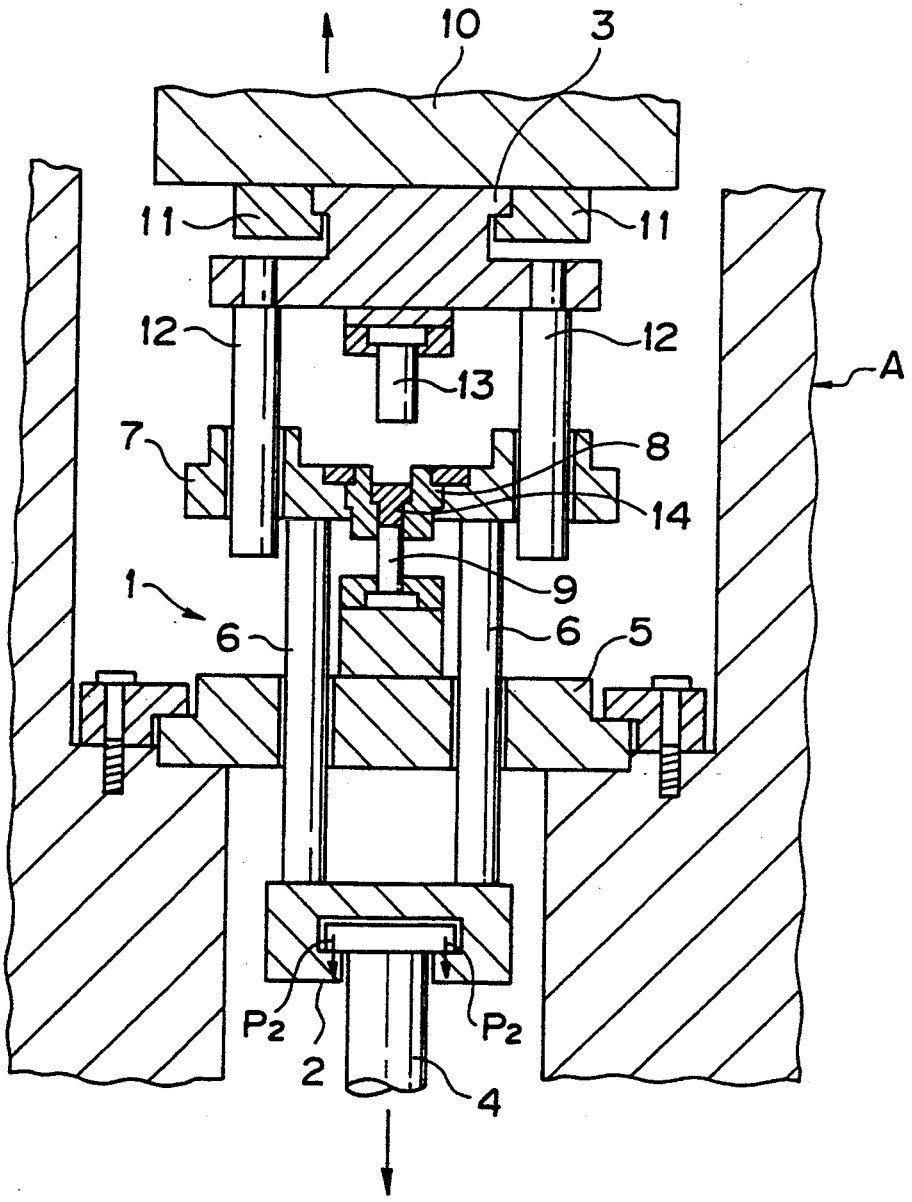
FIG.4 PRIOR ART
FIG. 4 is a view for showing a force applied to the lower ram when the molded product is pulled out of the device.

When the installing of the die set 1 into the main body A of the press is completed, said gap adjusting screw 16 is rotated in a clockwise direction by the operation of said rotary actuator 23 until said gap adjusting screw 16 abuts against said yoke plate 2 as shown in FIG. 2B. Then they are secured to have the gap G between said yoke plate 2 and said lower ram 4 with minimum value approximating to zero without any clearance. Thus disturbance of filling position of powder material into the pressing cavity as found in the prior art is prevented so that the accuracy of the molded product 14 of powder metallurgy is improved.

For pulling out of the die set 1 from the main body A of the press, said gap adjusting screw 16 is fully retracted with rotation of a counter-clockwise direction by driving of said rotary actuator 23 so that a sufficient interval is provided as the gap G which facilitates removal operation of the die set 1.

Although said rotary actuator 23 is employed as a means for rotating said gap adjusting screw 16 in the embodiment, an another driving means in which a reduction gear is combined with an induction motor, a DC motor, a servo-motor or the like might bemused in place of said rotary actuator 23, with a provision of a position setting means for stopping the gap adjusting screw at a position where the interval of gap G becomes minimum.

The press for powder metallurgy of the present invention is not limited to a hydraulic press, but a mechanical press may be also applicable.

As described above, in the present invention, the gap adjusting screw which is disposed within the lower ram is rotated by the driving means such as the rotary actuator at the lower end position of the lower ram so that the gap between the yoke plate and the lower ram is adjusted. Then for the insertion of the die set into the main body of the press, the gap can be sufficiently assured and the die set insertion into the main body of the press can be performed quite easily as compared with a case of the prior art in which only about 0.1–0.3 mm interval is obtainable as the gap.

After completion of installation of the die set to the main body of the press, the gap adjusting screw is rotated until the gap adjusting screw abuts against the yoke plate, so that they can be fixed with the gap minimum value approximating to zero of no clearance at all. Thus the accuracy of the molded product of powder metallurgy can be improved remarkably as compared with that of the prior art.

The above description of the specification is made only for explanation of the present invention and it is apparent for those skilled in the art that the present invention can be modified or improved in various forms or arrangements without departing from its spirit and scope; thus the scope of the present invention is limited only with the descriptions of the claims.

What is claimed is:

1. A press for powder metallurgy in which a die set with a yoke plate is installed to or removed from between an upper ram and a lower ram of a main body of the press, comprising;

a female screw provided at an upper part of said lower ram to which the yoke plate of said die set is installed, a gap adjusting screw engaged with said female screw, rotary driving means disposed at a lower part of the lower ram, a connecting shaft passing through a center of said lower ram and connected to the gap adjusting screw, and a driving shaft of said rotary driving means connected to said connecting shaft, said gap adjusting screw being retracted within said lower ram so as to assure a sufficient gap between said yoke plate and said lower ram when said die set is inserted into or removed from the main body of the press, and said gap adjusting screw being advanced forwardly after inserting the die set onto the lower ram until said gap adjusting screw abuts against the yoke plate.

2. A press for powder metallurgy as defined in claim 1 wherein said connecting shaft including linking means which does not permit rotational displacement while permitting vertical displacement between said driving shaft and said connecting shaft.

3. A press for powder metallurgy as defined in claim 2, further comprising guide means projecting from the main body, said guide means preventing rotational displacement of said rotary driving means while permitting vertical displacement thereof in relation to the main body of the press.

* * * * *